US006341951B1

(12) United States Patent
Chen et al.

(10) Patent No.: US 6,341,951 B1
(45) Date of Patent: Jan. 29, 2002

(54) COMBINATION DOUBLE SCREW ROTOR ASSEMBLY

(75) Inventors: Chun-chien Chen, Hsinchu Hsien; Tean-mu Shen, Hsinchu; Jung-chen Chein, Hsinchu Hsien; Ming-Hsin Liu, Hsinchu, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/639,944

(22) Filed: Aug. 17, 2000

(30) Foreign Application Priority Data

May 26, 2000 (TW) ..... 089208958

(51) Int. Cl.[7] ..... F01C 1/16; F01C 13/00
(52) U.S. Cl. ..... 418/9; 418/201.1
(58) Field of Search ..... 418/9, 201.1, 206.2

(56) References Cited

U.S. PATENT DOCUMENTS

| | | | | |
|---|---|---|---|---|
| 2,691,482 A | * | 10/1954 | Ungar | 418/9 |
| 3,807,911 A | * | 4/1974 | Caffrey | 418/201.1 |
| 4,714,418 A | * | 12/1987 | Matsubara et al. | 418/201.1 |
| 5,154,595 A | * | 10/1992 | Takeda | 418/206.2 |
| 5,443,644 A | | 8/1995 | Ozawa | 418/201.1 |
| 5,667,370 A | | 9/1997 | Im | 418/201.1 |
| 5,951,266 A | * | 9/1999 | Maruyama et al. | 418/9 |
| 5,975,867 A | * | 11/1999 | Grant et al. | 418/201.1 |

FOREIGN PATENT DOCUMENTS

| | | | | |
|---|---|---|---|---|
| JP | 56-14887 | * | 2/1981 | 418/201.1 |
| JP | 1-187391 | * | 7/1989 | 418/201.1 |
| RU | 1820035 | * | 6/1993 | 418/9 |

* cited by examiner

*Primary Examiner*—John J. Vrablik
(74) *Attorney, Agent, or Firm*—Rabin & Berdo, P.C.

(57) ABSTRACT

A combination double screw rotor assembly includes a first screw rotor and a second screw rotor arranged in parallel in a casing, the first screw rotor and the second screw rotor each having a low pressure screw rotor element, a high pressure screw rotor element, and a spiral thread formed of a first spiral thread segment at the high pressure screw rotor element and a second spiral thread segment at the low pressure screw rotor element, the first spiral thread segment having an uniform short pitch, the second spiral thread segment having an uniform long pitch, the upper spiral thread segment and second spiral thread segment of the first screw rotor being respectively meshed with the first spiral thread segment and second spiral thread segment of the second screw rotor. During operation of the combination double screw rotor assembly, the flow of air moves from relatively greater air chambers around the low pressure screw rotor elements of the screw rotors toward the relatively smaller air chambers around the high pressure screw rotor elements of the screw rotors, and is compressed in the relatively smaller air chambers, preventing a reverse flow due to a significant pressure difference between the forwarding flow of air and the area around the outlet, so as to minimize power loss and operation noise.

6 Claims, 4 Drawing Sheets

COMBINATION DOUBLE SCREW ROTOR ASSEMBLY

BACKGROUND OF THE INVENTION

The present invention relates to a double screw rotor assembly, and more particularly to a multi-segment or combination double screw rotor assembly for controlling a flow pressure, for example, for use in vacuum pumps, air compressors, etc.

FIG. 1 shows a double screw rotor assembly constructed according to U.S. Pat. No. 5,443,644. This structure of double screw rotor comprises two screw rotors 81 and 82 meshed together. Because the screw rotors 81 and 82 have an uniform pitch P' and same height of tooth H', the volume and pressure of the air chambers 810 and 820 are not variable. When operated through a certain length of time, a high pressure occurs in the area around the outlet 80, and a significant pressure difference occurs when air is transferred to the outlet 80, resulting in a reverse flow of air, high noises, and high energy consuming.

U.S. Pat. No. 5,667,370 (FIG. 2) discloses a horizontal type double screw rotor assembly. According to this design, the first pair of screw rotors 32' and 33 and the second pair of screw rotors 34 and 35 have different outer diameters and pitches. Further, the installation of the partition plate 93 between two shells 91 and 92 greatly increases the dimension of the screw rotor assembly and complicates its structure.

FIG. 3 shows still another structure of horizontal type double screw rotor assembly according to the prior art. According to this design, the screw rotors 4' and 5' have a variable pitch. However, because the processing of the screw rotors requires a specially designed processing equipment and cutting tool, the manufacturing cost of this structure of double screw rotor is high.

SUMMARY OF THE INVENTION

The present invention has been accomplished to provide a combination double screw rotor assembly, which eliminates the aforesaid drawbacks. It is one object of the present invention to provide a combination double screw rotor assembly, which effectively prevents a reverse flow, and reduces power loss and operation noise. It is another object of the present invention to provide a combination double screw rotor, which is compact and requires less installation space. It is still another object of the present invention to provide a combination double screw rotor assembly, which is easy and inexpensive to manufacture. According to one aspect of the present invention, the combination double screw rotor assembly comprises a casing, a first screw rotor, and a second screw rotor. The casing comprises an inside wall defining a receiving chamber, an inlet, and an outlet. The first rotor comprises a shaft pivoted in the casing, a low pressure screw rotor element and a high pressure screw rotor element respectively mounted on the shaft in a direction from the inlet toward the outlet, and a spiral thread raised around the periphery thereof and extended over the low pressure screw rotor element and high pressure screw rotor element. The spiral thread of the first rotor is comprised of a first spiral thread segment raised around the periphery of the low pressure screw rotor element of the first rotor and defining a uniform long pitch, and a second spiral thread segment raised around the periphery of the high pressure screw rotor element of the first rotor and defining an uniform short pitch. The second screw rotor comprises a shaft pivoted in the casing and disposed in parallel to the shaft of the first screw rotor, a low pressure screw rotor element and a high pressure screw rotor element respectively mounted on the shaft of the second rotor in a direction from the inlet toward the outlet, and a spiral thread raised around the periphery thereof and extended over the low pressure screw rotor element and high pressure screw rotor element of the second rotor. The spiral thread of the second rotor is comprised of a first spiral thread segment raised around the periphery of the low pressure screw rotor element of the second rotor and defining a uniform long pitch, and a second spiral thread segment raised around the periphery of the high pressure screw rotor element of the second rotor and defining a uniform short pitch. The first spiral thread segment and second spiral thread segment of the spiral thread of the second screw rotor are respectively meshed with the first spiral thread segment and second spiral thread segment of the first screw rotor. According to another aspect of the present invention, two parallel sets of axle bearings are mounted in the casing near the outlet to support the shafts of the first screw rotor and the second screw rotor, and keyless axle bushes or like device are installed in the shafts of the first screw rotor and the second screw rotor to secure the axle gearings in place. According to still another aspect of the present invention, timing gears are respectively mounted on the shafts of the first screw rotor and the second screw rotor and meshed together for enabling the first screw rotor and the second screw rotor to be rotated without contact.

DETAILED DESCRIPTION OF THE PREFERRED EMBODIMENT

Figure 1:
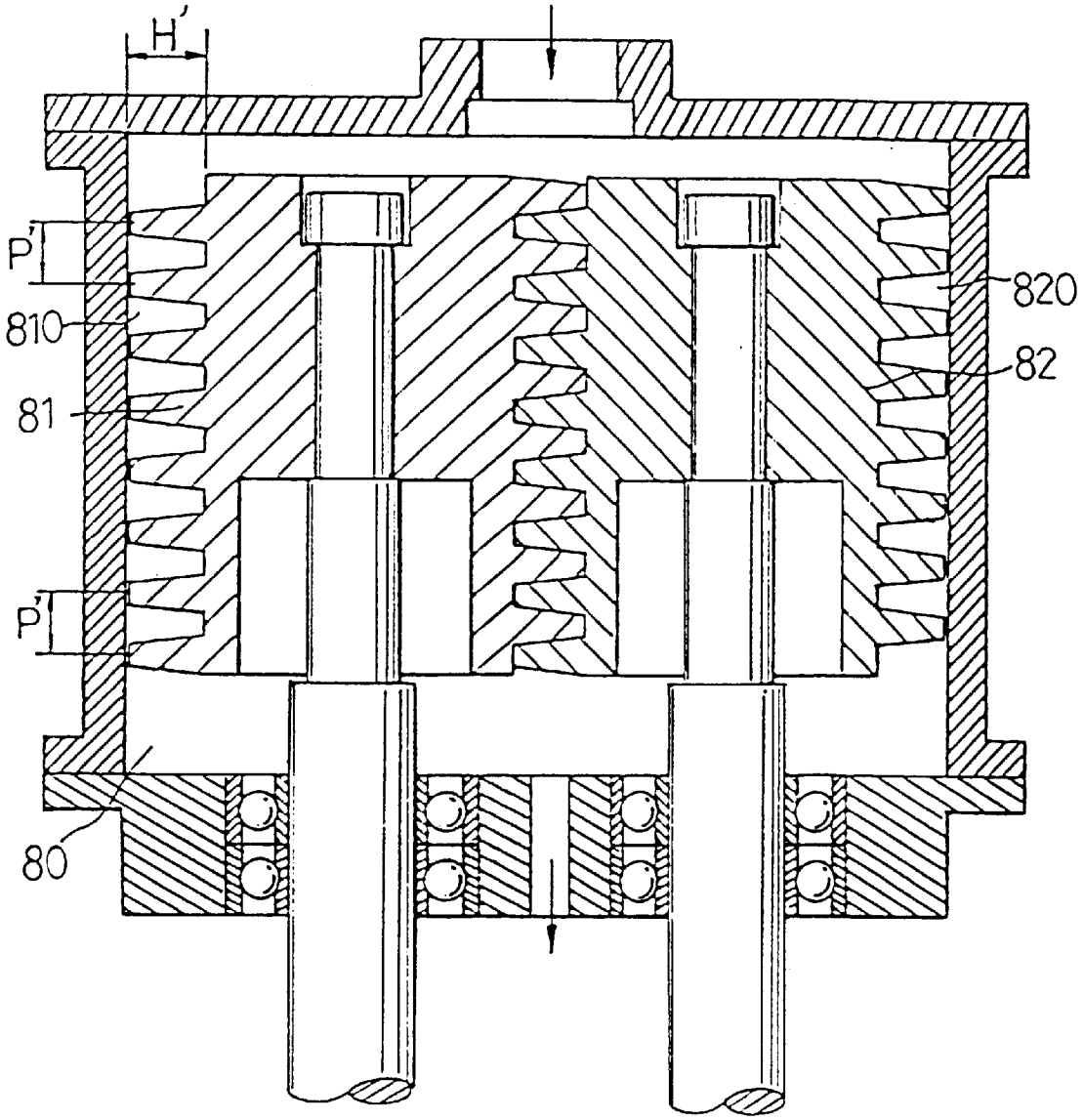
Fig. 1 (PRIOR ART)
FIG. 1 is a sectional view of a double screw rotor assembly according to the prior art.
Figure 2:
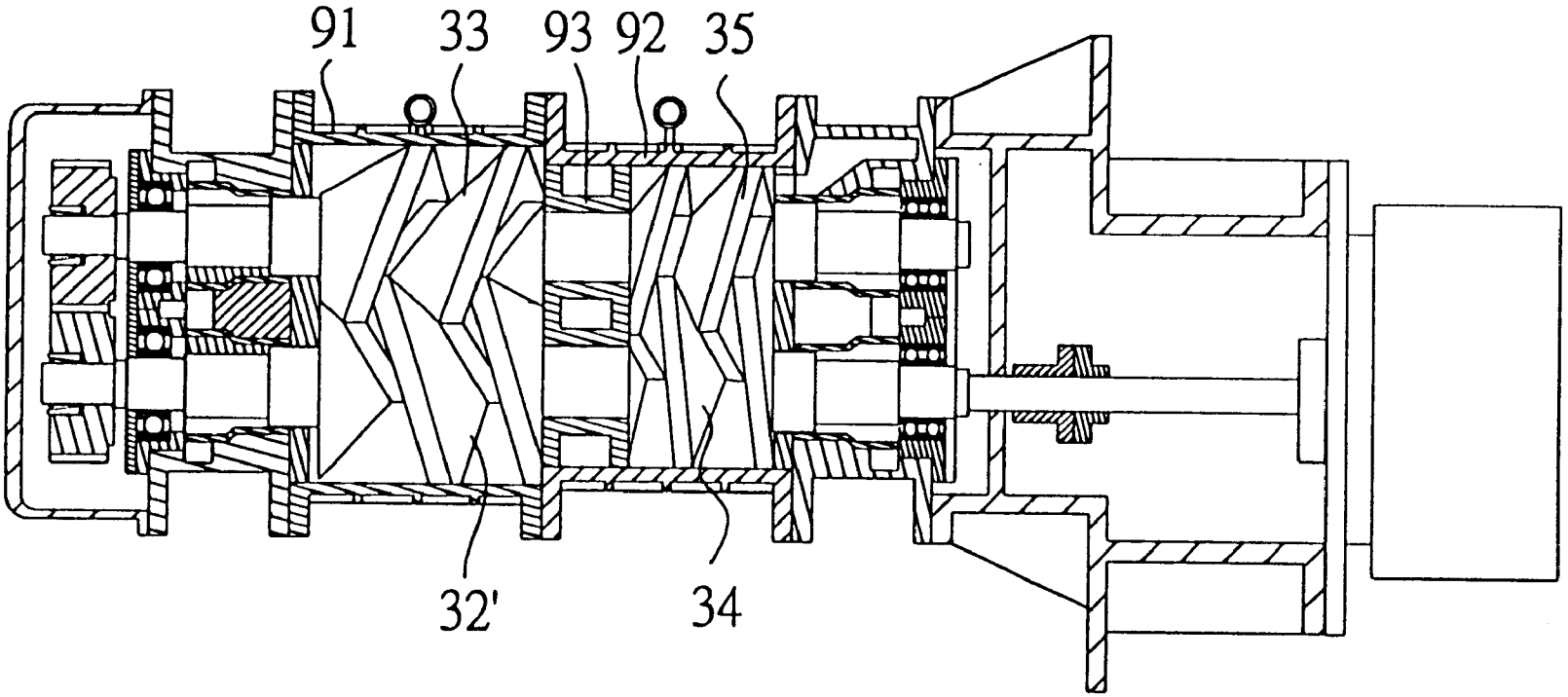
Fig. 2 (PRIOR ART)
FIG. 2 is a sectional view of another structure of double screw rotor assembly according to the prior art.
Figure 3:
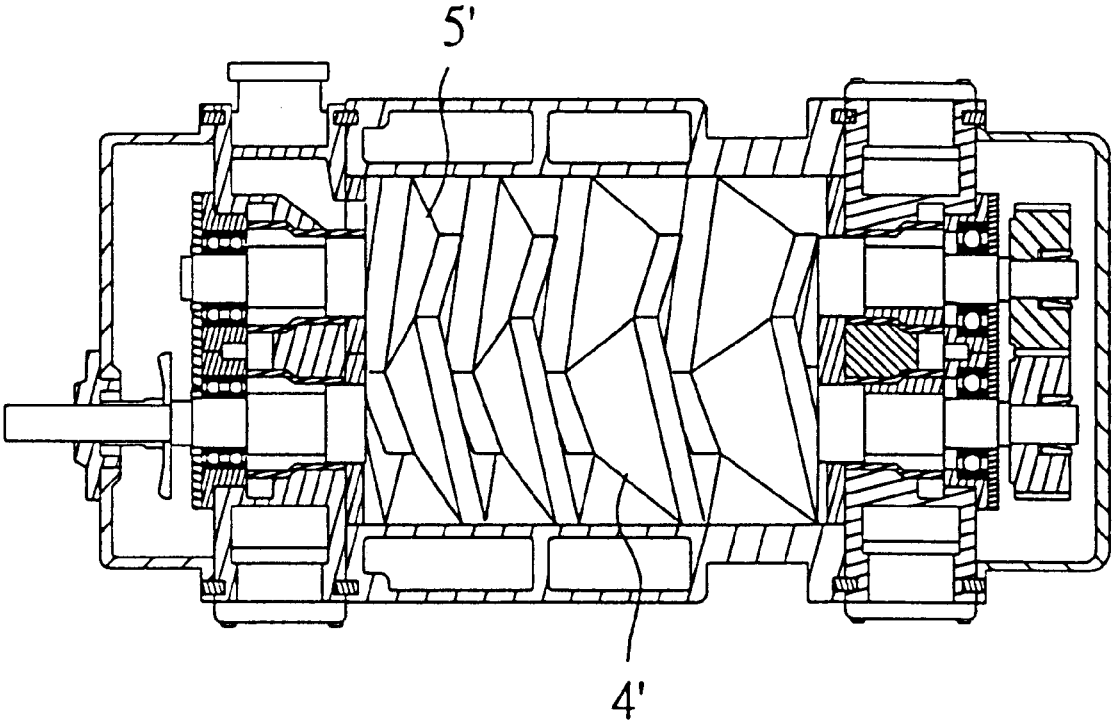
Fig. 3 (PRIOR ART)
FIG. 3 is a sectional view of still another structure of double screw rotor assembly according to the prior art.
Figure 4:
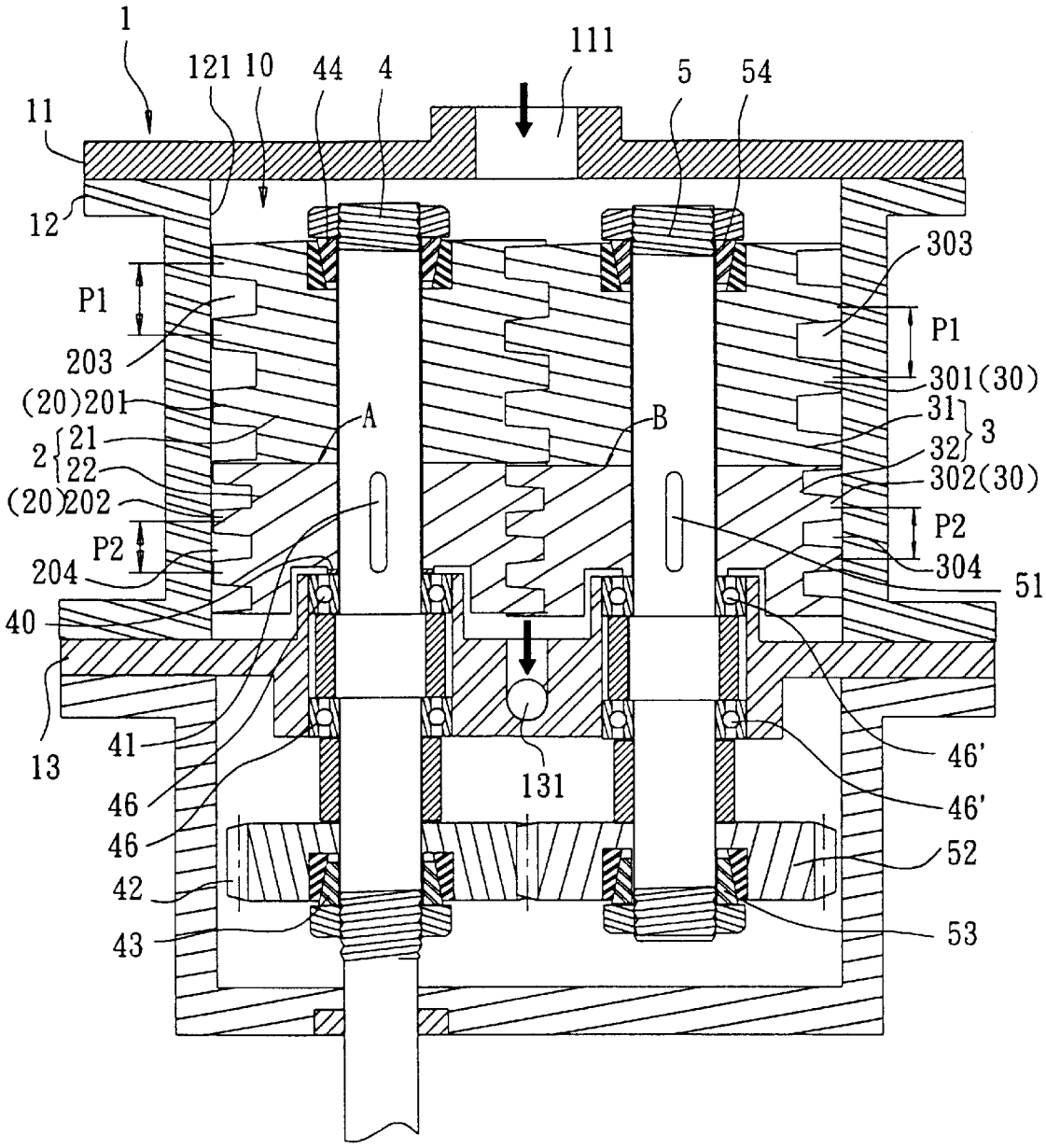
FIG. 4 is a sectional view of a combination double screw rotor assembly according to the present invention.

Referring to FIG. 4, a combination double screw rotor assembly is shown adapted for use in a vacuum pump, comprised of a casing 1, a first screw rotor 2, and a second screw rotor 3.

The casing 1 comprises a top cover 11, a peripheral shell 12, and a bottom cover 13. The top cover 11 has an inlet 111 connected to an enclosure to be drawn into a vacuum condition. The peripheral shell 12 comprises an inside wall 121 defining a receiving chamber 10. The bottom cover 13 comprises an outlet 131 disposed in communication with the atmosphere, and two parallel sets of axle bearings 46 and 46', adapted to support respective shafts 4 and 5 of the screw rotors 2 and 3, on the bottom cover 13.

The first screw rotor 2 comprises a low pressure screw rotor element 21 and a high pressure screw rotor element 22 axially connected in a line and extended in a direction from the inlet 111 toward the outlet 131, and a spiral thread 20 raised around the periphery thereof and extended over the low pressure screw rotor element 21 and the high pressure screw rotor element 22. The spiral thread 20 is comprised of a first spiral thread segment 201 raised around the periphery of the low pressure screw rotor element 21 and defining a uniform long pitch P1, and a second spiral thread segment 202 raised around the periphery of the high pressure screw rotor element 22 and defining a uniform short pitch P2. The second screw rotor 3 comprises a low pressure screw rotor element 31 and a high pressure screw rotor element 32 axially connected in a line and extended in direction from the inlet 111 toward the outlet 131, and a spiral thread 30 raised around the periphery thereof and extended over the low pressure screw rotor element 31 and the high pressure screw rotor element 32. The spiral thread 30 is comprised of a first spiral thread segment 301 raised around the periphery of the low pressure screw rotor element 31 and defining a uniform long pitch P1, and a second spiral thread segment 302 raised around the periphery of the high pressure screw rotor element 32 and defining a uniform short pitch P2 (the uniform long pitch P1 and uniform short pitch P2 of the first screw rotor 2 are identical to that of the second screw rotor 3 so that same respective reference signs P1 and P2 are used).

The assembly process of the present invention is outlined hereinafter with reference to FIG. 4 again. The shafts 4 and 5 are respectively mounted in the respective axle bearings 46 and 46' at the bottom cover 13, and then the high pressure screw rotor elements 22 and 32 of the first screw rotor 2 and the second screw rotor 3 are meshed together and respectively mounted on the shafts 4 and 5 and secured thereto by respective keys 41 and 51, and then checked if the top sides A and B of the high pressure screw rotor elements 22 and 32 are disposed at the same elevation or not. If the top sides A and B of the high pressure screw rotor elements 22 and 32 are not horizontally aligned, a packing 40 is inserted in between the high pressure screw rotor segment 22 and the respective axle bearing 46, enabling the top sides A and B of the high pressure screw rotor elements 22 and 32 to be adjusted to the same elevation. After the top sides A and B of the high pressure screw rotor elements 22 and 32 have been adjusted to the same elevation, the two meshed timing gears 42 and 52 are mounted on the shafts 4 and 5 at one end, and then the phase angle of the timing gears 42 and 52 is adjusted and the clearance between the high pressure screw rotor elements 22 and 32 is adjusted, and then two keyless axle bushes 43 and 53 are fastened to the shafts 4 and 5 and the timing gears 42 and 52 to hold down the timing gears 42 and 52 in place. After installation of the timing gears 42 and 52 and the keyless axle bushes 43 and 53, the timing gears 42 and 52 can then be driven to rotate the high pressure screw rotor elements 22 and 32, keeping the predetermined clearance between the high pressure screw rotor elements 22 and 32, and preventing friction between the high pressure screw rotor segments 22 and 32. Therefore, less noise is produced during the rotation of the high pressure screw rotor elements 22 and 32.

Thereafter, the low pressure screw rotor elements 21 and 31 are meshed together and respectively mounted on the shafts 4 and 5 at the other end. Because the first spiral thread segment 201 (or 301) and the second spiral thread segment 202 (or 302) are designed to form a continuously extended spiral thread 20 (or 30), the thread segments 201 and 202 (or 301 and 302) can easily be aligned. After installation, the low pressure screw rotor elements 21 and 31 are well adjusted to have the designed clearance left therebetween, and then respective keyless axle bushes 44 and 54 are installed to secure the low pressure screw rotor elements 21 and 31 to the shafts 4 and 5. As stated above, axle bearings 46 and 46' are installed in the high pressure side near the outlet 131 to support the shafts 4 and 5 positively in place. It is unnecessary to install additional axle bearings in the low pressure side near the inlet 111. Because no axle bearings are required in the low pressure side near the inlet 111, the invention prevents the possibility of reverse flow of evaporated lubricating grease from the double screw rotor assembly to the enclosure to be drawn into a vacuum condition. Therefore, the invention is practical for use in semiconductor manufacturing equipment where the cleanness of the chamber is critical.

As shown in FIG. 4, the first spiral thread segment 201 of the low pressure screw rotor element 21 of the first screw rotor 2 and the first spiral thread segment 301 of the low pressure screw rotor element 31 of the second screw rotor 3 are meshed together and have an uniform long pitch P1; the second spiral thread segment 202 of the high pressure screw rotor element 22 of the first screw rotor 2 and the second spiral thread segment 302 of the high pressure screw rotor element 32 of the second screw rotor 3 are meshed together and have an uniform short pitch P2 (P2<P1). Therefore, the volume of the air chambers 204 and 304 in the high pressure screw rotor elements 22 and 32 is smaller than the volume of the air chambers 203 and 303 in the low pressure screw rotor elements 21 and 31. During rotary operation of the double screw rotor assembly, the flow of air in the air chambers 203 and 303 is compressed in advance, preventing a significant pressure difference between the low pressure side near the inlet 111 and the high pressure side near the outlet 131, and therefore the possibility of a reverse flow is greatly reduced, and less power loss and operation noise will occur. This design enables the double screw rotor assembly to be made compact. Because the processing of the component parts is easy, the manufacturing cost of the double screw rotor is low.

As shown, the respective keyless axle bushes each include a tapered inner sleeve disposed around an end of a respective shaft 4, 5, and a tapered outer sleeve disposed within a recess formed in an end of the component to be fixed, i.e., low pressure screw rotor elements 21, 31, or timing gears 42, 52. Each tapered inner sleeve is received within a respective tapered outer sleeve using a nut.

While only one embodiment of the present invention has been shown and described, it will be understood that various modifications and changes could be made thereunto without departing from the spirit and scope of the invention disclosed.

What the invention claimed is:

1. A combination double screw rotor assembly, comprising:

a casing, said casing comprising an inside wall defining a receiving chamber, an inlet, and an outlet;

a first rotor, said first rotor comprising a shaft axially-rotatably mounted in said casing, a low pressure screw rotor element and a high pressure screw rotor element respectively mounted on said shaft of said first rotor in a direction from said inlet toward said outlet, and a spiral thread raised around a periphery thereof and extending over the low pressure screw rotor element and high pressure screw rotor element of said first rotor, the spiral thread of said first rotor being comprised of a first spiral thread segment raised around a periphery of the low pressure screw rotor element of said first rotor and defining a uniform long pitch, and a second spiral thread segment raised around a periphery of the high pressure screw rotor element of said first rotor and defining a uniform short pitch;

a second screw rotor, said second screw rotor comprising a shaft axially-rotatably mounted in said casing and disposed in parallel to said shaft of said first screw rotor, a low pressure screw rotor element and a high pressure screw rotor element respectively mounted on said shaft of said second rotor in the direction from said inlet toward said outlet, and a spiral thread raised around the periphery thereof and extending over the low pressure screw rotor element and high pressure screw rotor element of said second rotor, the spiral thread of said second rotor being comprised of a first spiral thread segment raised around a periphery of the low pressure screw rotor element of said second rotor and defining a uniform long pitch, and a second spiral thread segment raised around a periphery of the high pressure screw rotor element of said second rotor and defining a uniform short pitch, the first spiral thread segment and second spiral thread segment of the spiral thread of said second screw rotor being respectively meshed with the first spiral thread segment and second spiral thread segment of said first screw rotor;

two sets of axle bearings respectively mounted in said casing near said outlet to support the shaft of said first rotor and the shaft of said second rotor; and a plurality of keyless axle bushes respectively fastened to the shaft of said first screw rotor and the shaft of said second screw rotor in a region near said inlet, each keyless axle bush including a tapered inner sleeve, a tapered outer sleeve disposed around the tapered inner sleeve, and a nut that urges the tapered inner sleeve into engagement with the tapered outer sleeve to secure the respective low pressure screw rotor elements of said first screw rotor and said second screw rotor to the respective shafts;

wherein the use of said keyless axle bushes allows the region near said inlet to be maintained free of axle bearings, thereby preventing evaporated lubricating grease from being drawn by a reverse flow into said inlet.

2. The combination double screw rotor assembly of claim 1, further comprising a plurality of keys respectively fastened to the shaft of said first screw rotor and the shaft of said second screw rotor to secure the respective high pressure screw rotor elements of said first screw rotor and said second screw rotor to the respective shafts.

3. The combination double screw rotor assembly of claim 1 further comprising packing means respectively installed in between said axle bearings and the high pressure screw rotor segments of said first screw rotor and said second screw rotor to adjust the height of the high pressure screw rotor segments of said first screw rotor and said second screw rotor at same elevation.

4. The combination double screw rotor assembly of claim 1 wherein said casing is comprised of a top cover, a peripheral shell, and a bottom cover.

5. The combination double screw rotor assembly of claim 1 further comprising a set of timing gears adapted to transmit the rotary power between the shaft of said first screw rotor and the shaft of second screw rotor, preventing friction contact between the spiral thread of said first screw rotor and the spiral thread of said second screw rotor.

6. The combination double screw rotor assembly of claim 5 further comprising a plurality of keyless axle bushes adapted to secure said timing gears to the shaft of said first screw rotor and the shaft of said second screw rotor respectively.

* * * * *